US006695189B1

(12) United States Patent
Dolas

(10) Patent No.: US 6,695,189 B1
(45) Date of Patent: Feb. 24, 2004

(54) ACCESSORY POCKET

(76) Inventor: Michael Dolas, 1164 Crestline Dr., Santa Barbara, CA (US) 93105

( * ) Notice: Subject to any disclaimer, the term of this patent is extended or adjusted under 35 U.S.C. 154(b) by 0 days.

(21) Appl. No.: 10/083,748

(22) Filed: Feb. 25, 2002

(51) Int. Cl.[7] ..... A45F 5/00

(52) U.S. Cl. ..... 224/661; 224/673; 224/677; 224/911; 383/119; 383/120

(58) Field of Search ..... 224/661, 673, 224/677, 678, 911; D3/222; 383/119, 120

(56) References Cited

U.S. PATENT DOCUMENTS

| | | | | | |
|---|---|---|---|---|---|
| 2,342,324 | A | * | 2/1944 | Allen | 229/117.33 |
| D187,533 | S | * | 3/1960 | Castaneda | D30/1 |
| D206,983 | S | * | 2/1967 | Knight | D87/5 |
| 3,482,758 | A | * | 12/1969 | Pierre et al. | 229/117.27 |
| D237,078 | S | * | 10/1975 | Taylor | D3/2 |
| 4,101,060 | A | * | 7/1978 | Bianchi et al. | 224/674 |
| 4,223,709 | A | * | 9/1980 | Myklebust | 383/7 |
| 4,303,185 | A | * | 12/1981 | Shoemaker | 224/193 |
| D270,929 | S | * | 10/1983 | Shasteen et al. | D22/13 |
| 4,485,947 | A | * | 12/1984 | Cook | 224/243 |
| 4,750,656 | A | * | 6/1988 | Bianchi et al. | 224/673 |
| 4,781,475 | A | * | 11/1988 | LaFleur | 383/119 |
| 4,903,859 | A | * | 2/1990 | Derby et al. | 383/41 |
| 5,150,825 | A | * | 9/1992 | Nichols | 224/243 |
| 5,328,268 | A | * | 7/1994 | Lafleur | 383/119 |
| 5,409,153 | A | * | 4/1995 | Ristich | 224/661 |
| 5,503,477 | A | * | 4/1996 | Schlough | 383/207 |

* cited by examiner

*Primary Examiner*—Stephen P. Garbe
(74) *Attorney, Agent, or Firm*—Michael G. Petit

(57) ABSTRACT

A belt-attached accessory pocket for containing articles, such as a personal communication device, has a rectangular portion and is made from flexible fabric. It has front and rear surfaces, an open upper edge, and sealed lower, leading and trailing edges. A reinforcing panel of durable material, such as leather, encloses the leading edge and adjacent portions of the front and rear surfaces and resists damage due to abrasion. The panel preferably has a holster shape. The upper edge of the panel is substantially coextensive with the upper edge of the accessory pocket and includes a flap that releasably closes the open upper edge. The pocket may further include a separate, inner cell phone pocket affixed to the fabric. The pocket may also include a pair of leather thongs to be tied around the leg of the wearer.

3 Claims, 2 Drawing Sheets

ACCESSORY POCKET

BACKGROUND OF THE INVENTION

1. Field of the Invention

An accessory pocket for attachment to the belt of a wearer.

2. Prior Art

Accessory bags such as "fanny packs" and cell phone holders are well represented in the art. In the case of c-phone holders, it is customary to clip the holder to the belt of the wearer. While c-phone holders are useful for carrying a cell phone, they are generally useful for carrying anything else. Fanny packs, which are provided with a dedicated belt, are adapted to carry a variety of articles and, therefore, have flexible utility. Belt bags, which are similar to fanny packs, lack a dedicated belt and are adapted to be attached to a wearer's belt. Belt bags offer more flexible utility than a c-phone holder and are generally more stylish and less obtrusive than a fanny pack. Nevertheless, due to their relatively small size, they provide the user less flexibility and versatility than a fanny pack.

Similarly, holsters for pistols are a familiar accessory that has been worn by law enforcement personnel and the military for many years. Such holsters are belt mountable and are made from a variety of materials, particularly leather. The compartment within a holster is generally pistol-shaped and dimensioned to snugly contain a pistol. They lack the flexibility for carrying articles other than a pistol and pistol-related articles such as bullets. Nevertheless, the general appearance of such holsters has a stylish appeal to a portion of the population. It would be desirable to provide an accessory pocket that presents an image similar to a holster and the flexibility of a fanny pack, and has a versatile compartment for storing and carrying accessories such as a cell phone and/or cosmetic items.

SUMMARY

It is an object of the invention to provide a durable accessory pocket having a pocket portion made from a flexible fabric, the pocket portion having a front surface and a rear surface connected to each other at a sealed leading edge, a sealed trailing edge and a sealed bottom edge to form a compartment between the front and read surfaces; and a reinforcing panel affixed to the front and rear surfaces of the pocket portion and disposed to overlie and protect the sealed leading edge of the pocket portion against abrasion.

It is a further object of the invention to provide an accessory pocket meeting the above objective wherein the reinforcing panel is leather and wherein the reinforcing panel comprises a holster-shaped front portion overlying a portion of the front surface of the pocket portion adjacent the sealed leading edge thereof.

It is still a further object of the invention to provide an accessory pocket meeting the above objectives wherein the reinforcing panel comprises a holster-shaped front portion overlying a portion of the front surface of the pocket portion adjacent the sealed leading edge thereof and a rear portion overlying and affixed to the rear surface of the pocket portion, the rear portion of the reinforcing panel having a flap extending upwardly from said open upper edge of the pocket portion, the flap being operable for releasably closing the open upper edge of the pocket portion.

It is another object of the invention to provide an accessory pocket meeting the above objectives and wherein the reinforcing panel comprises means for attaching the accessory poclet to a person's belt and a pair of thongs extending downwardly from the lower sealed edge of the accessory pocket, the thongs being dimensioned to be tied around a wearers leg when the accessory pocket is attached to the belt of the person.

It is still another object of the invention to provide an accessory pocket meeting the above objectives wherein the trailing edge of the pocket portion is gusseted.

It is another object of the invention to provide an accessory pocket meeting any of the above objectives and wherein the compartment comprising the pocket portion is partitioned to include a cell phone holder.

The features of the invention believed to be novel are set forth with particularity in the appended claims. However the invention itself, both as to organization and method of operation, together with further objects and advantages thereof may be best understood by reference to the following description taken in conjunction with the accompanying drawings in which:

DESCRIPTION OF THE PREFERRED EMBODIMENTS

Figure 1:
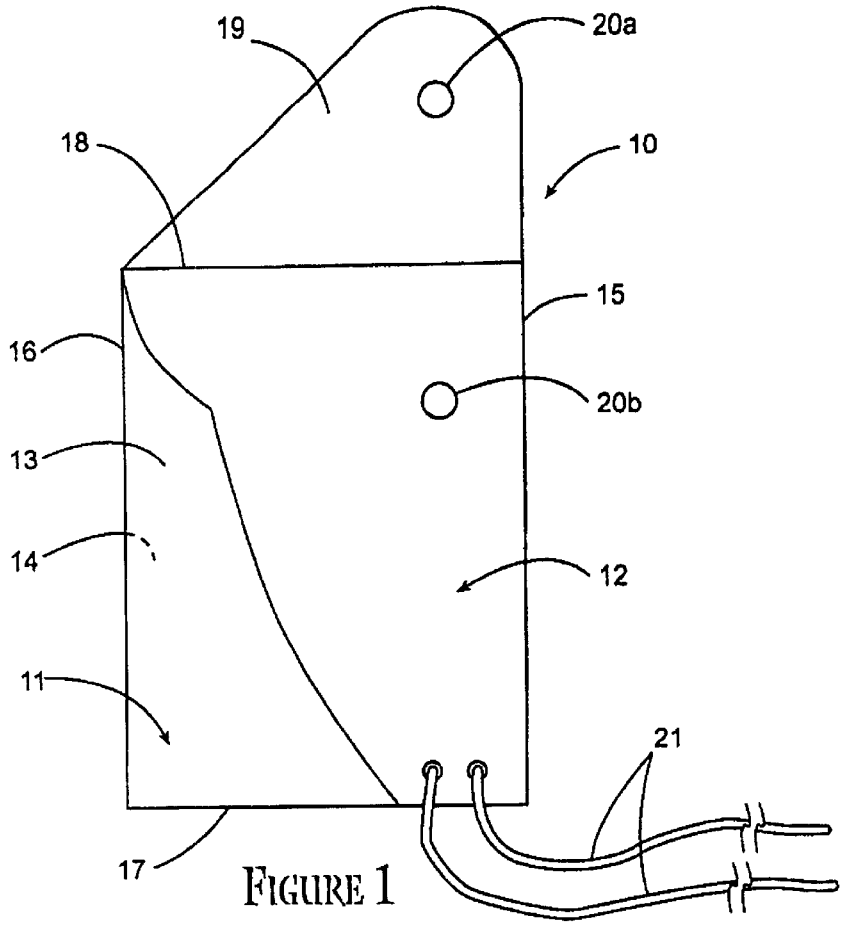
FIG. 1 is a perspective view of an accessory pocket in accordance with a preferred embodiment of the present invention.

FIG. 1 is a front view of an accessory pocket, indicated at numeral 10, in accordance with a preferred embodiment of the present invention. The accessory pocket 10 has a pocket portion 11 and a reinforcing panel 12. The pocket portion 10 is comprised of a flexible sheet of a durable fabric such as canvas or denim, formed into a pocket. The pocket portion 11 has a front surface 13 and a rear surface 14 (not visible in FIG. 1). The pocket portion has a sealed leading edge 15, a sealed trailing edge 16, a sealed bottom edge 17 and an open upper edge 18. The space between the front surface 13 and the rear surface 14 defines a compartment.

The reinforcing panel 12, which is made from a sheet of material such as leather that is more resistant to abrasion than the fabric, wraps around the leading edge 15 of the pocket portion 11 and is affixed to the front surface 13 and rear surface 14 of the pocket portion, such as, for example, by sewing. The portion of the reinforcing panel 12 affixed to the rear surface 14 of the pocket portion 11 has a flap 19 projecting upwardly from the open upper edge 18 of the pocket portion. The flap 19 includes fastening means **20*a* adapted to matingly and releasably engage fastening means 20*b* affixed to the front surface of the reinforcing panel 12. The flap 19 provides a closure for the open upper edge 18 of the pocket portion 11**.

Figure 2:
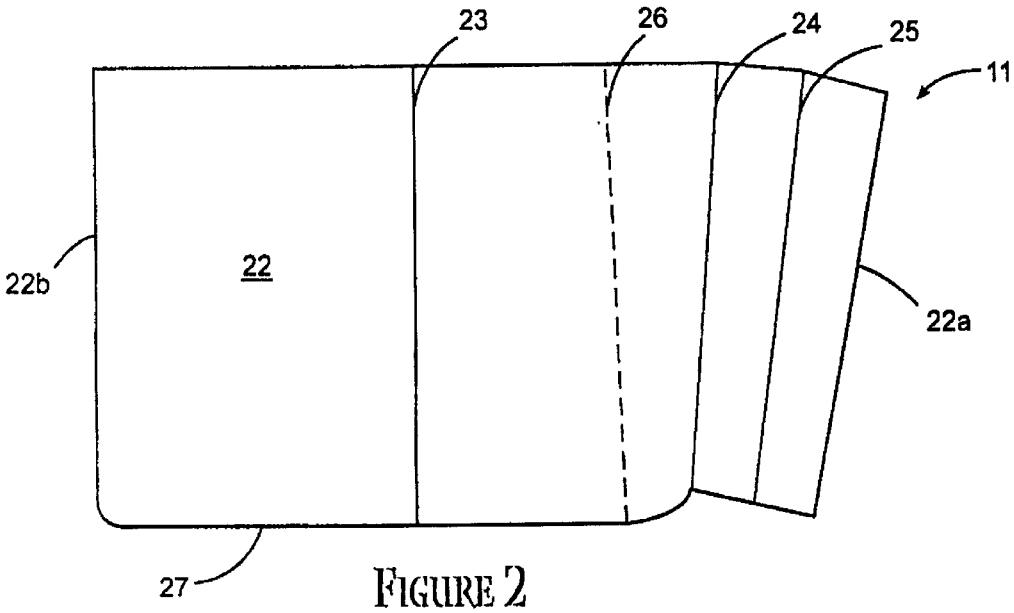
FIG. 2 is a top plan view of a sheet of fabric cut to be formed into the pocket portion of the accessory pocket.
Figure 3:
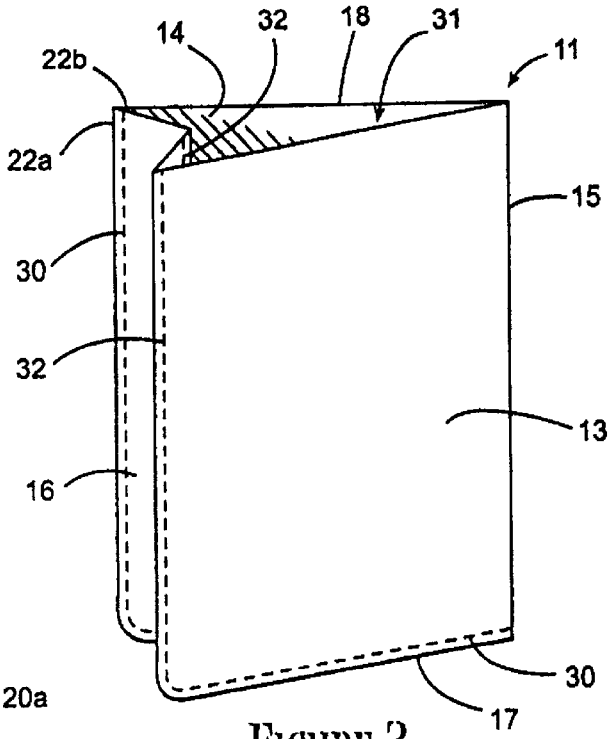
FIG. 3 is a somewhat front and top perspective view of a sheet of flexible fabric, cut in accordance with FIG. 2, sewn to form the pocket portion of the accessory pocket.

Turning now to FIG. 2, a sheet of fabric 22, cut to be formed into the pocket portion of the accessory pocket, is shown in top plan view. With reference to the discussion of the formation of the pocket portion that follows, the term "forwardly" means toward the viewer, while "rearwardly" means away from the viewer. The flat sheet 22 has three fold lines 23, 24 and 25. To form the pocket portion 11, right edge 22*a* is folded rearwardly along fold line 25 to form a crease and then the crease thus formed along fold line 25 is folded forwardly along fold line 24 to superimpose fold line 25 upon guide line 26. The left edge 22*b* of the sheet 22 is then folded forwardly along fold line 23 and brought into juxtaposition with right edge 22*a* and affixed thereto. The bottom edge 27 is then sealed by sewing 30 (FIG. 3) or by an adhesive. The pocket portion is shown in perspective view in FIG. 3. Fold lines 24 and 25 comprising the gusseted trailing edge 16 of the pocket portion 11 are preferably prestiched, as shown at stitches 30 and 32, to enable the gusseted trailing edge 16 to spontaneously conform into an accordion fold.

Figure 4:
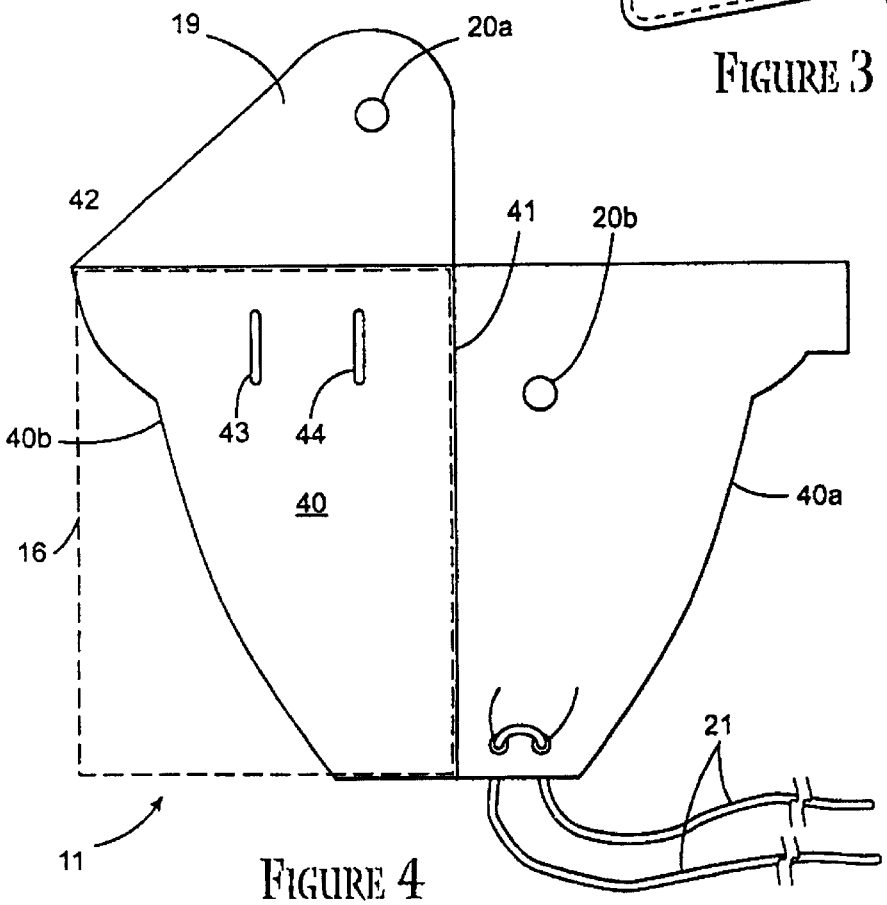
FIG. 4 is a top plan view of a sheet of leather cut to form the reinforcing panel of the accessory pocket.

FIG. 4 is a top plan view of a sheet of leather 40 cut to form the reinforcing panel 12 comprising the accessory pocket 10. The sheet of leather 40 has a right curvilinear edge 40*a,* a left edge 40*b,* and two fold lines 41 and 42. A pair of slots 43 and 44 in the sheet 40 provide means for attaching the accessory pocket 10 to the belt of a wearer. A pair of holes 45 and 46 provide means for fastening a thong 21 to the reinforcing panel. A portion of the top surface of the sheet exclusive of the flap 19 is coated with an adhesive. The pocket portion 11 (dotted line in FIG. 4) is placed on the sheet 40 such that the leading edge 15 of the pocket portion is in juxtaposition with fold line 41 and the upper open edge 18 of the pocket portion is in alignment with fold line 42. To form the reinforcing panel 12 on the pocket portion, the right curvilinear edge 40*a* is folded forwardly along fold line 41 and brought into juxtaposition with left edge 40*b,* the edges 40*a* and 40*b* being separated by the pocket portion, a portion of which is sandwiched between the folded leather sheet 40 comprising the reinforcing panel 12. Flap fastening means such as a snap or hook and loop fasteners 20*a* and 20*b* are attached to the reinforcing panel as indicated. The flap 19 is folded forwardly along fold line 42 to provide releasable open upper edge closure means.

It may be desirable to provide the compartment 31 (FIG. 3) in the pocket portion 11 with one or more dedicated compartments for storage of particular article(s) such as a cell phone. Such a dedicated compartment can be attached to the sheet of fabric 22 (FIG. 2) prior to forming the pocket portion 11. The fabric 22 may be of a color and texture that matches the fabric of the wearers pants. In such an instance, the accessory pocket 10 has the appearance of a leather holster. Such an appearance has an appeal for some people, conjuring up romantic images such as Indiana Jones or law enforcement officers of the old west. The thong 21 may be tied around the leg to indicate, for example, that the wearer is committed to a personal relationship, or untied to indicate, for example, that the wearer does not presently enjoy a committed relationship.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. An accessory pocket having a pocket portion consisting of a flexible fabric, the pocket portion having a front surface and a rear surface connected to each other at a sealed leading edge, a sealed, gusseted trailing edge and a sealed bottom edge to form a compartment between said front and rear surfaces; and a reinforcing panel affixed to said front and rear surfaces of said pocket portion, said reinforcing panel being disposed to overlie said sealed leading edge of said pocket portion and operable for protecting said sealed leading edge against abrasion and wherein said reinforcing panel is leather and comprises a holster-shaped front portion overlying a portion of said front surface of said pocket portion adjacent said sealed leading thereof, and a rear portion overlying and affixed to said rear surface of said pocket portion, said rear portion of said reinforcing panel having a flap extending upwardly from said open upper edge upper edge of said pocket portion, said flap being operable for releasably closing said open upper edge of said pocket portion.

2. The accessory pocket of claim 1 wherein said reinforcing panel comprises means for attaching said accessory pocket to a person's belt, and a pair of thongs extending downwardly from said lower sealed edge of said accessory pocket, said thongs being dimensioned to be tied around the person's leg when said accessory pocket is attached to the belt of the person.

3. The accessory pocket of claim 1 wherein said compartment comprising said pocket portion is partitioned to include a cell phone holder therewithin.

* * * * *